US007709176B2

(12) United States Patent
Takashima et al.

(10) Patent No.: US 7,709,176 B2
(45) Date of Patent: May 4, 2010

(54) METHOD FOR PRODUCING POLYMERIZED TONER

(75) Inventors: Junichi Takashima, Tokyo (JP); Takashi Iga, Tokyo (JP); Keita Sensui, Tokyo (JP)

(73) Assignee: Zeon Corporation, Tokyo (JP)

( * ) Notice: Subject to any disclaimer, the term of this patent is extended or adjusted under 35 U.S.C. 154(b) by 833 days.

(21) Appl. No.: 11/511,334

(22) Filed: Aug. 29, 2006

(65) Prior Publication Data

US 2007/0048645 A1 Mar. 1, 2007

(30) Foreign Application Priority Data

Aug. 31, 2005 (JP) ..... 2005-252819
Feb. 27, 2006 (JP) ..... 2006-050836

(51) Int. Cl.
*G03G 9/08* (2006.01)

(52) U.S. Cl. ..... 430/137.15; 430/137.16

(58) Field of Classification Search ..... 430/137.15, 430/137.16

See application file for complete search history.

(56) References Cited

U.S. PATENT DOCUMENTS 6,939,656 B2 * 9/2005 Tanaka et al. ..... 430/137.15
2004/0110081 A1 * 6/2004 Tanaka et al. ..... 430/137.15

FOREIGN PATENT DOCUMENTS

JP 51-100485 A 4/1993
JP 2001-92180 A 4/2001
JP 2001-117272 4/2001
JP 2004-271816 9/2004

* cited by examiner

*Primary Examiner*—Mark A Chapman
(74) *Attorney, Agent, or Firm*—Westerman, Hattori, Daniels & Adrian, LLP

(57) ABSTRACT

A method for producing a polymerized toner comprising a step of polymerizing a polymerizable monomer composition in an aqueous dispersion medium in the presence of a polymerization initiator to obtain a dispersion liquid of colored polymer particles and a stripping step of injecting a gas comprised of air or an inert gas into the dispersion liquid of the colored polymer particles while stirring the dispersion liquid in an evaporator and the flow rate of the gas injected per weight of the colored polymer particles being 0.05 to 4 L/(hr·kg), the pressure of the vapor phase of the evaporator being 5 to 80 kPa.

12 Claims, 1 Drawing Sheet

METHOD FOR PRODUCING POLYMERIZED TONER

FIELD OF THE INVENTION

The present invention relates to a polymerized toner used for development in a copier, facsimile, printer, etc. using the electrophotographic process and a method for producing the polymerized toner.

BACKGROUND OF THE INVENTION

In a copier, facsimile, printer, or other image forming apparatus using the electrophotographic process, the electrostatic latent image formed on the photosensitive body is converted to a visible image by a developer (hereinafter referred to as a "toner"). A toner is mainly comprised of a binder resin in which colored particles comprised of a colorant and, in accordance with need, a charge control agent, parting agent, etc. are dispersed.

Toners are roughly classified by process of production into pulverized toners comprised of colored particles obtained by the pulverizing method and polymerized toners giving colored particles by the polymerization method (in the present invention, colored particles obtained by the polymerization method are referred to as "colored polymer particles"). With the pulverizing method, a binder resin comprised of a thermoplastic resin is melt kneaded with a colorant, charge control agent, parting agent, and other additive ingredients, pulverized, and classified to obtain colored particles and produce the pulverized toner. As opposed to this, with the polymerization method, a polymerizable monomer composition containing a polymerizable monomer, colorant, and other additives is used to form droplets in an aqueous dispersion medium which are then polymerized to produce colored polymer particles forming the polymerized toner.

Recently, color copiers, printers, and other image forming apparatuses using the electrophotographic process are rapidly spreading. In color image formation, photographs and other high definition images are also being formed, so image formation with a particularly high resolution and good color reproducibility is being sought. High quality color toners able to meet with this demand are considered necessary. From this viewpoint, spherical toners are suitable in that they are good in transferability and dot reproducibility. The suspension polymerization method, dispersion polymerization method, emulsion polymerization method, and other polymerization methods enable spherical toners to be produced with a good efficiency, so toners made by the polymerization method (polymerized toners) are becoming the mainstream.

On the other hand, recently, environmental regulations are being toughened. In such image forming apparatuses as well, therefore, the low molecular weight ingredients which volatilize when fixing a toner by heat such as the polymerizable monomer remaining in the toner (in the present invention, hereinafter referred to as the "residual monomer") and other volatile organic compounds (in the present invention, hereinafter referred to as the "residual VOC") are becoming an issue. Further, if the toner contains a large amount of residual monomer or residual VOC, offset easily occurs, a film of the toner easily forms on the surface of parts of the image forming apparatus such as the photosensitive body and development blade, and other problems arise.

Therefore, to produce toners with little residual monomer and residual VOC, in the past methods have been proposed for removing the residual monomer and residual VOC from the colored polymer particles after polymerization. Removal of the residual monomer and residual VOC is more difficult with toners made by the polymerization method than with toners made by the pulverizing method. That is, with the pulverizing method, it is possible to remove the residual monomer and residual VOC using means such as heat treatment of only the binder resin before the colored particles are formed. As opposed to this, with the polymerization method, the colored polymer particles (colored particles) are formed simultaneously with the polymerization, therefore this removal step must be performed after the formation of the colored particles. For this reason, the residual monomer etc. are easily absorbed in the ingredients other than the binder resin (colorant, charge control agent, parting agent, etc.) and therefore are difficult to remove compared with the case of only a binder resin. Further, if overly heating by a long time or high temperature, the colored polymer particles aggregate, the other ingredients besides the binder resin in the colored polymer particles become degraded, and for other reasons, the obtained toner easily declines in quality.

In recent years, there have been increasing demands for lowering the lowest fixing temperature so as to increase the speed of printing, save power, etc. Further, with full color printing, four colors are superposed, so a high print durability of the different colors of toners even in different environments is being sought. In such toners, it has been extremely difficult to remove the residual monomer and residual VOC without aggregation of the colored polymer particles, degradation of the ingredients in the colored polymer particles, etc. causing a drop in the toner quality.

As the stripping method for removing residual monomer and residual VOC from the aqueous dispersion medium containing colored polymer particles obtained by the polymerization method, various methods have been proposed in the past.

Japanese Patent Application Laid-Open No. 5-100485 discloses the method of steam stripping comprising blowing saturated steam into the aqueous dispersion medium containing colored polymer particles obtained by the polymerization method. However, with this method, there was the problem that the shear force when the saturated steam came into contact with the colored polymer particles easily led to agglomeration of the colored polymer particles.

Further, Japanese Patent Application Laid-Open No. 2001-92180 discloses a process of production of a toner comprising running a relatively large amount of nitrogen gas through the vapor phase of a distillation system containing the aqueous dispersion medium containing colored polymer particles obtained by the polymerization method and reducing the pressure for the purpose of stripping. However, even if using this method, the efficiency of removal of the residual monomer etc. is insufficient. Further, there was the problem that the obtained polymerized toner ends up deteriorating in print durability. Further, a large amount of nitrogen or other gas is used, so the energy consumption ends up increasing.

Further, Japanese Patent Application Laid-Open No. 2004-271816 proposes a process of production of a toner comprising injecting nitrogen gas at an normal pressure of by 101 kPa into an aqueous dispersion medium containing colored polymer particles obtained by the polymerization method for the purpose of stripping. According to this method, it was possible to efficiently remove the residual monomer, but there was the problem that the efficiency of removal of the residual VOC was insufficient and if increasing the flow rate of the nitrogen for improving the efficiency, a large amount of bubbles would form in the aqueous dispersion medium making operation impossible.

SUMMARY OF THE INVENTION

An object of the present invention is to provide a method of stably and efficiently produce a polymerized toner with little residual monomer and residual VOC, good in print durability even under various temperature and humidity environments, and superior in environmental safety.

The inventors intensively studied the method of stripping for removing residual monomer and residual VOC from an aqueous dispersion medium including colored polymer particles obtained by the polymerization method and as a result discovered that by injecting a gas comprised of air or an inert gas under reduced pressure of specific conditions by a specific flow rate, it is possible to stably and efficiently produce a polymerized toner with little residual monomer and residual VOC and excellent in print durability even under various temperature and humidity environments.

According to the present invention, there is provided a method for producing a polymerized toner comprising a step of polymerizing a polymerizable monomer composition containing a colorant and polymerizable monomer in an aqueous dispersion medium in the presence of a polymerization initiator to obtain a dispersion liquid of colored polymer particles and a stripping step of injecting a gas comprised of air or an inert gas into the dispersion liquid of the colored polymer particles while stirring the dispersion liquid in an evaporator, the flow rate of the gas injected per weight of the colored polymer particles being 0.05 to 4 L/(hr·kg), the pressure of the vapor phase of the evaporator being 5 to 80 kPa.

In the present invention, in the stripping step, the aqueous dispersion medium preferably contains at least one type of non-silicone deformer selected from the group comprised of an oil/fat deformer, mineral oil deformer, polyether deformer, polyalkyleneglycol type nonionic surfactant, emulsion containing an oil/fat and polyalkyleneglycol type nonionic surfactant, and emulsion containing a mineral oil and polyalkyleneglycol type nonionic surfactant.

Further, in the present invention, preferably the stripping conditions are controlled so that the bubble level on the surface of the dispersion liquid of the colored polymer particles is not more than 95% of the height of the evaporator and the range of fluctuation of the level of bubbles becomes within 10% throughout the stripping process. Further, in the present invention, more preferably the stripping step stirs the dispersion liquid of the colored polymer particles at a stirring rate of 1 to 50 rpm in range and controls the dispersion liquid of the colored polymer particles to a temperature of 45° C. to 90° C.

Further, particularly preferably, the polymerizable monomer composition contains a molecular weight modifier in an amount of 0.01 part by weight to 2 parts by weight with respect to 100 parts by weight of the monovinyl monomer forming the main ingredient of the polymerizable monomer.

BRIEF DESCRIPTION OF THE DRAWINGS

These and other objects and features of the present invention will become clearer from the following description of the preferred embodiments given with reference to the attached drawings, wherein.

DESCRIPTION OF THE PREFERRED EMBODIMENTS

Figure 1:
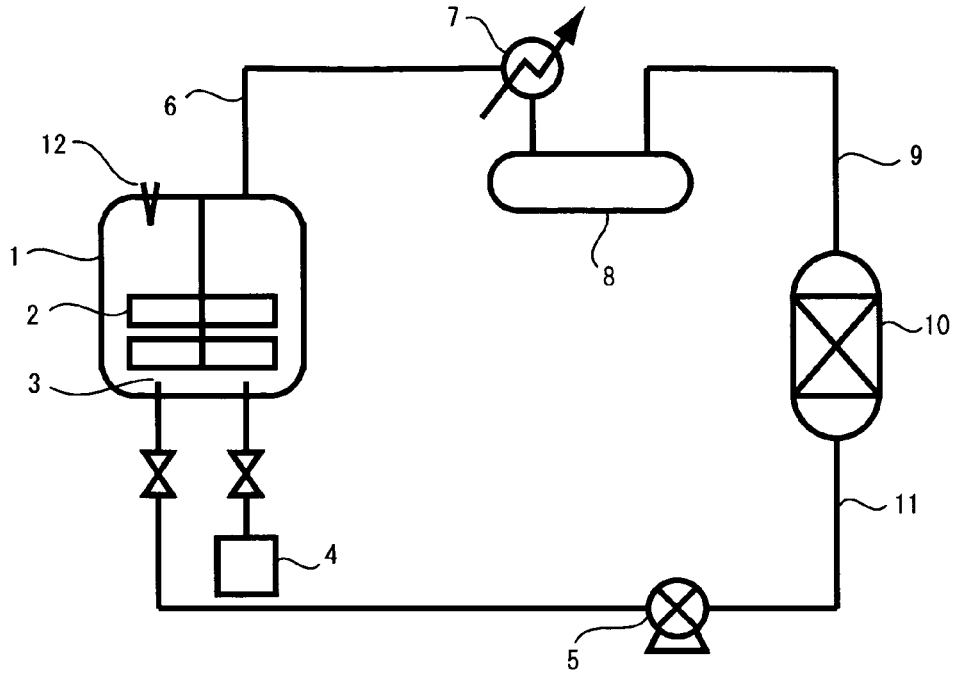
FIG. 1 is a view of a stripping system used in the examples of the present invention and FIG. 2 is a view of a stripping system employed in Comparative Example 5.

Below, a process of production of a polymerized toner according to an embodiment of the present invention will be explained. First, a polymerizable monomer, colorant, and further, in accordance with need, other additives are mixed to obtain a polymerizable monomer composition. This polymerizable monomer composition is placed in an aqueous medium, a polymerization initiator is added, droplets are formed, then polymerized to obtain an aqueous dispersion liquid of colored polymer particles. Next, the aqueous dispersion liquid of the colored polymer particles obtained by the polymerization is stripped to remove the residual monomer or residual VOC in the colored polymer particles. After this, the obtained colored polymer particles are washed, dewatered, and dried and, in accordance with need, classified, and, further, in accordance with need, given an external additive to obtain a polymerized toner.

(1) Polymerizable Monomer Composition

A polymerizable monomer, colorant, and, further, in accordance with need, other additives are mixed to obtain a polymerizable monomer composition. The colorant and other additives are preferably mixed so as to be able to be dissolved in or as uniformly and finely dispersed as possible in the polymerizable monomer. This type of mixing is performed.

In the present invention, a "polymerizable monomer" means a compound able to be polymerized. As the main ingredient of the polymerizable monomer, a monovinyl monomer is preferably used. As the monovinyl monomer, for example, styrene; vinyltoluene, α-methylstyrene, and other styrene derivatives; acrylic acid and methacrylic acid; methyl acrylate, ethyl acrylate, propyl acrylate, butyl acrylate, 2-ethylhexyl acrylate, dimethylaminoethyl acrylate, and other acrylic acid esters; methyl methacrylate, ethyl methacrylate, propyl methacrylate, butyl methacrylate, 2-ethylhexyl methacrylate, dimethylaminoethyl methacrylate, and other methacrylic acid esters; acrylonitrile, methacrylonitrile, acrylamide, methacrylamide, and other acrylic acid derivatives and methacrylic acid derivatives; ethylene, propylene, butylene, and other olefins; vinyl chloride, vinylidene chloride, vinyl fluoride, and other vinyl halides and vinylidene halides; vinyl acetate, vinyl propionate, and other vinyl esters; vinyl methyl ether, vinyl ethyl ether, and other vinyl ethers; vinyl methyl ketone, methyl isopropenyl ketone, and other vinyl ketones; 2-vinyl pyridine, 4-vinyl pyridine, N-vinylpyrrolidone, and other nitrogen-containing vinyl compounds may be mentioned. These monovinyl monomers may be used singly or in any combination thereof. Among these, as the monovinyl monomer, styrene, a styrene derivative, or an acrylic acid or methacrylic acid derivative is preferably used.

The monovinyl monomer is preferably selected so that the polymer obtained by its polymerization has a glass transition temperature (hereinafter referred to as a "Tg") of not more than 80° C. The monovinyl monomer may be used either singly or in any combination thereof to adjust the Tg of the polymer to the desired range.

To improve the hot offset, along with the monovinyl monomer, it is preferable to use any cross-linkable polymerizable monomer. The cross-linkable polymerizable monomer means a monomer having at least two polymerizable functional groups. As the cross-linkable polymerizable monomer, for example, divinylbenzene, divinylnaphthalene, their derivatives, and other aromatic divinyl compounds; ethyleneglycol dimethacrylate, diethyleneglycol dimethacrylate, and other diacrylate compounds; N,N-divinylaniline, divinylether, and other divinyl compounds; compounds having at least three vinyl groups, etc. may be mentioned. These cross-linkable polymerizable monomers may be used either singly or in any combination thereof. In the present invention, the cross-linkable polymerizable monomer is preferably used in a ratio of usually 0.1 to 5 parts by weight, preferably 0.3 to 2 parts by weight, with respect to 100 parts by weight of the monovinyl monomer.

Further, if using a macromonomer as part of the polymerizable monomer, the balance between the shelf stability and the low temperature fixing ability becomes good, so this is preferred. The macromonomer is a reactive oligomer or polymer having carbon-carbon unsaturated double bonds able to be polymerized with the ends of the molecular chain and having a number average molecular weight of usually 1,000 to 30,000. The macromonomer preferably gives a polymer having a Tg higher than the Tg of a polymer obtained by polymerization of a monovinyl monomer. The amount of the macromonomer is usually 0.01 to 10 parts by weight, preferably 0.03 to 5 parts by weight, more preferably 0.05 to 1 part by weight, with respect to 100 parts by weight of the monovinyl monomer.

In the present invention, a colorant is used, but when preparing color toners (usually four types of toners, that is, a black toner, cyan toner, yellow toner, and magenta toner, are used), a black colorant, cyan colorant, yellow colorant, and magenta colorant can be used.

As the black colorant, carbon black, titanium black, iron zinc oxide, iron nickel oxide, or another magnetic powder or other pigment may be used.

As the cyan colorant, for example, a copper phthalocyanine compound, its derivative, an anthraquinone compound, etc. may be used. Specifically, C. I. Pigment Blue 2, 3, 6, 15, 15:1, 15:2, 15:3, 15:4, 16, 17:1, 60, etc. may be mentioned. Due to the good stability of polymerization and coloring ability, C. I. Pigment Blue 15, 15:1, 15:2, 15:3, 15:4, 17:1, and other copper phthalocyanine compounds are preferable and C. I. Pigment Blue 15:3 is more preferable.

As the yellow colorant, for example, a monoazo pigment, diazo pigment, or other azo pigment, condensation and polycyclic pigment, or other compound may be used. Specifically, C. I. Pigment Yellow 3, 12, 13, 14, 15, 17, 62, 65, 73, 74, 83, 93, 97, 120, 138, 155, 180, 181, 185, 186, etc. may be mentioned. Due to the good stability of polymerization and coloring ability, C. I. Pigment Yellow 3, 15, 65, 73, 74, 97, 120, and other monoazo pigments are preferable and C. I. Pigment Yellow 74 is more preferable.

As the magenta colorant, for example, a monoazo pigment, diazo pigment, or other azo pigment, condensation and polycyclic pigment, or other compound is used. Specifically, C. I. Pigment Red 31, 48, 57:1, 58, 60, 63, 64, 68, 81, 83, 87, 88, 89, 90, 112, 114, 122, 123, 144, 146, 149, 150, 163, 170, 184, 185, 187, 202, 206, 207, 209, 251, and C. I. Pigment Violet 19 etc. may be mentioned. Due to the good stability of polymerization and coloring ability, C. I. Pigment Red 31, 48, 57:1, 58, 60, 63, 64, 68, 112, 114, 146, 150, 163, 170, 185, 187, 206, 207, and other monoazo pigments are similarly preferable.

The amount of the addition of the colorant is preferably 1 to 10 parts by weight with respect to 100 parts by weight of the monovinyl monomer.

The polymerizable monomer composition may also have further added to it, in addition to the polymerizable monomer and colorant, in accordance with need, a charge control agent, molecular weight modifier, parting agent, or other additive.

As the charge control agent, various positive charging or negative charging ability charge control agents can be used. For example, non-resin charge control agents such as metal complexes of organic compounds having carboxyl groups or nitrogen-containing groups, metal-containing dyes, and nigrosine; charge control resins such as copolymers containing quaternary ammonium salt groups, copolymers containing sulfonic acid groups or sulfonic acid salt groups, and copolymers containing carboxylic acid groups or carboxylic acid salt groups; etc. may be used. Due to the good print durability of the toner, the charge control agent preferably includes the charge control resin, more preferably is comprised of just the charge control resin. As the charge control resin, a copolymer containing a quaternary ammonium salt group or a copolymer containing a sulfonic acid group or a sulfonic acid salt group is more preferable. The charge control agent is used in an amount of normally 0.01 to 10 parts by weight, preferably 0.03 to 8 parts by weight, with respect to 100 parts by weight of the monovinyl monomer.

As another additive, a molecular weight modifier is preferably used. As the molecular weight modifier, t-dodecylmercaptan, n-dodecylmercaptan, n-octylmercaptan, 2,2,4,6,6-pentamethylheptane-4-thiol, and other mercaptans may be mentioned. The molecular weight modifier may be added before the start of polymerization or during the polymerization. The amount of the molecular weight modifier is preferably 0.01 to 2 parts by weight, more preferably 0.1 to 1 part by weight, particularly preferably 0.1 to 0.5 part by weight, with respect to 100 parts by weight of the monovinyl monomer. If less than that range, the effect of the molecular weight adjustment is not obtained, while conversely if greater, the residual monomer and residual VOC increase.

Further, as another additive, a parting agent is preferably added to improve the release of the toner from the fixing roll at the time of fixing. As the parting agent, any agent may be used without particular limitation if generally used as a toner parting agent. A low molecular weight polyethylene, low molecular weight polypropylene, low molecular weight polybutylene, and other low molecular weight polyolefin waxes; molecule terminal-oxidized low molecular weight polypropylene, low molecular weight terminal-modified polypropylene with a molecule terminal substituted with an epoxy group, block polymers of these with low molecular weight polyethylene, molecule terminal-oxidized low molecular weight polyethylene, low molecular weight polyethylene with a molecule terminal substituted with an epoxy group, block polymers of these with low molecular weight polypropylene, and other terminal-modified polyolefins waxes; candellila wax, carnauba wax, rice wax, Japan wax, johoba wax, and other plant-based natural waxes; paraffin wax, microcrystalline wax, petrolactam, and other petroleum waxes and their modified waxes, montan wax, ceresin, ozokerite, and other mineral waxes; Fischer-Tropsch wax and other synthetic waxes; pentaerythritol tetramyristate, pentaerythritol tetrapalmitate, pentaerythritol tetrastearate, pentaerythritol tetralaurate, and other pentaerythritol esters or dipentaerythritol hexamyristate, dipentaerythritol hexapalmitate, dipentaerythritol hexalaurate, and other dipentaerythritol esters and other polyhydric alcohol ester compounds; etc. may be mentioned. These may be used either singly or in any combination thereof.

Among these, pentaerythritol ester having an endothermic peak temperature, as measured from a DSC curve at the time of temperature rise using a differential scan calorimeter, of 30 to 150° C., preferably 50 to 120° C., more preferably 60 to 100° C. in range, a dipentaerythritol ester having an endothermic peak temperature of 50 to 80° C. in range, and other polyhydric alcohol ester compounds are particularly preferable from the viewpoint of the balance of the fixability and releasability. The parting agent is used in an amount of preferably 0.1 to 30 parts by weight, more preferably 1 to 20 parts by weight, with respect to 100 parts by weight of the monovinyl monomer.

In the preparation of the polymerizable monomer composition, it is preferable that the ingredients added to the polymerizable monomer are dissolved or the colorants are dispersed with a good dispersability, then the above other ingredients are added. As the method for dispersing the colorant in the polymerizable monomer, various types of known methods may be employed, but a method using a media disperser is preferred and a method using a media disperser provided with a media separation screen is particularly preferred. The above other ingredients are added to the obtained mixture to obtain the polymerizable monomer composition.

(2) Droplet Forming Step

In this embodiment, the above obtained polymerizable monomer composition is dispersed in the aqueous medium, the polymerization initiator is added, then the polymerizable monomer composition is formed into droplets. The method of formation of the droplets is not particularly limited, but for example may use an in-line type emulsion disperser (made by Ebara Corporation, product name "Milder"), a high speed emulsion disperser (made by Tokushu Kika Kogyo, product name "T.K. Homomixer MARK II"), or other device enabling strong stirring.

The aqueous medium in the present invention is a medium containing water as a main ingredient. It may contain an alcohol or other organic solvent soluble in water as a secondary ingredient. The aqueous medium preferably contains a dispersion stabilizer (in this embodiment, an aqueous medium containing the dispersion stabilizer is referred to as an "aqueous dispersion medium"). As the dispersion stabilizer, barium sulfate, calcium sulfate, and other sulfates; barium carbonate, calcium carbonate, magnesium carbonate, and other carbonates; calcium phosphate and other phosphates; aluminum oxide, titanium oxide, and other metal oxides; aluminum hydroxide, magnesium hydroxide, ferric hydroxide, and other metal hydroxides; and other metal compounds or other inorganic compounds dissolving in an acid or alkali may be mentioned. Further, polyvinyl alcohol, methylcellulose, gelatin, and other water soluble polymers; anionic surfactants; nonionic surfactants; amphoteric surfactants; and other organic compounds may also be used together. The dispersion stabilizers may be used either singly or in any combination thereof.

If using the dispersion stabilizer, preferably a metal compound, more preferably a water insoluble metal hydroxide colloid, the droplets of the polymerizable monomer may be given a sharp particle diameter distribution, Further, the agglomeration of colored polymer particles in the polymerization and the stripping step can be reduced and further the remaining amount of the dispersion stabilizer after washing is small, so the obtained polymerized toner can sharply reproduce an image and has a less detrimental effect on the stability of the environment.

As the polymerization initiator for the polymerization of the polymerizable monomer composition, potassium persulfate, ammonium persulfate, and other persulfates; 4,4'-azobis (4-cyanovaleric acid), 2,2'-azobis(2-methyl-N-(2-hydroxyethyl)propionamide, 2,2'-azobis(2-amidinopropane) dihydrochloride, 2,2'-azobis(2,4-dimethyl-valeronitrile), 2,2'-azobisisobutyronitrile, and other azo compounds; di-t-butyl peroxide, benzoyl peroxide, t-butylperoxy-2-ethyl hexanoate, t-hexylperoxy-2-ethyl hexanoate, t-butyl peroxypivalate, diisopropyl peroxydicarbonate, di-t-butyl peroxyisophthalate, t-butyl peroxyisobutyrate, and other peroxides may be mentioned. Further, a redox initiator combining the polymerization initiator and a reducing agent may also be used. Among these, since the residual polymerizable monomer can be reduced and the durability is good, peroxides are preferably used.

In the present embodiment, as the polymerization initiator, an organic peroxide is used, preferably a peroxy ester is used. By using such a polymerization initiator, the polymerizable monomer is efficiently polymerized. As a result, a polymerized toner having a small content of the main ingredient styrene of the polymerizable monomer, superior in storability, not giving off any odor during printing, and not having a detrimental effect on the ambient environment can be obtained.

In polymerization using a polymerization initiator comprised of an organic peroxide, for example, when the initiator is a peroxy ester, if the peroxy ester is broken down by heat, it is first broken down into the corresponding alcohol radical and carboxylic acid radical, then these radicals and the alkyl radicals produced by decarboxylation of the carboxylic acid radicals are added to the monomer, so the polymerization reaction progresses. However, these radicals sometimes produce byproducts such as various ether ingredients due to recoupling or draining of the hydrogen.

On the other hand, among the organic peroxides, organic peroxides which have a high risk of explosion due to impact or heating have to be diluted by the addition of a diluent for use. When using such an organic peroxide as the polymerization initiator, the presence of the diluent results in a greater susceptibility to an increase in volatile substances remaining in the obtained colored polymer particles. Further, when using an organic peroxide containing a large amount of an organic peroxide different from the organic peroxide of the main ingredient as an impurity as the polymerization initiator, since the impurity organic peroxide differs in suitable reaction conditions from the main ingredient organic peroxide, the initiator efficiency is reduced and there is a greater susceptibility to an increase in the polymerizable monomer or ether ingredient remaining in the obtained colored polymer particles.

Among the organic peroxides, due to its good initiator efficiency and smaller amount of residual polymerizable monomer, a peroxy ester is preferable, while a nonaromatic peroxy ester, that is, a peroxy ester not having an aromatic ring, is more preferable. Further, the organic peroxide is preferably a peroxy ester of the formula (1) below.

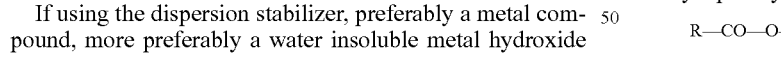

R—CO—O—O—R' formula (1)

In the formula (1), R and R' indicate an alkyl group. The R in the formula is preferably a C6 or less alkyl group, more preferably is a C5 or less one. Isopropyl, 1-methylpropyl, 1-ethylpropyl, 1-methylbutyl, 2-methylbutyl, 3-methylbutyl, 1-ethylpropyl, and other secondary alkyl groups are more preferable, while 1-methylpropyl and 1-ethylpropyl are particularly preferable. Further, in the formula (1), R' is preferably a C8 or less alkyl group, more preferably t-butyl and t-hexyl, particularly preferably t-butyl. As specific examples of the peroxy ester of formula (1), t-hexylperoxy pivalate (t-hexylperoxy-2,2-dimethyl-acetate), t-butylperoxy-2-ethyl butanoate, t-butylperoxy-2-methyl butanoate, etc. may be mentioned.

In the present embodiment, the organic peroxide of the main ingredient has a molecular weight of preferably 205 or less, more preferably 170 to 200, still more preferably 175 to 195. Further, in the present embodiment, the organic peroxide has a purity, expressed as the weight % of the organic peroxide of the main ingredient with respect to the total organic peroxide, of preferably 90% or more, more preferably 92% or more, still more preferably 95% or more.

The organic peroxide has a one hour half life temperature of preferably 70° C. to 95° C., more preferably 75° C. to 95° C., still more preferably 85° C. to 95° C., since a polymerized toner with a good print durability is obtained. Here, the "half life temperature" is an indicator of the ease of cleaving of the polymerization initiator. It shows the temperature when the polymerization initiator held at a constant temperature breaks down and becomes half of the original amount of initiator after a constant time. For example, with a one hour half life temperature, it is the half life temperature where this constant time becomes 1 hour.

By using the polymerization initiator, it is possible to reduce the unreacted polymerizable monomer remaining in the obtained colored polymer particles, the ether ingredient produced as a byproduct from the polymerization initiator, etc. As a result, it is possible to obtain a toner aimed at by the present invention, that is, a toner superior in high temperature storability, not giving off any odor at the time of printing, not having a detrimental effect on the ambient environment, and further superior in durability when printing at a high temperature and high humidity.

The polymerization initiator may be added to the polymerizable monomer composition, but may also be added after the polymerizable monomer composition is dispersed in the aqueous medium and before formation of droplets. The amount of addition of the polymerization initiator used for the polymerization of the polymerizable monomer composition is, with respect to 100 parts by weight of the monovinyl monomer, preferably 0.1 to 20 parts by weight, more preferably 1 to 15 parts by weight, most preferably 3 to 10 parts by weight. If in the above range, the polymerization proceeds efficiently and there is less residual monomer or residual VOC in the colored polymer.

(3) Polymerization Step

The aqueous dispersion medium containing the droplets obtained in the droplet forming step is raised in temperature for polymerization. The polymerization temperature of the polymerizable monomer composition is preferably at least 50° C., more preferably 60 to 120° C. Further, the reaction time of the polymerization is preferably 1 to 20 hours, more preferably 2 to 15 hours.

The colored polymer particles may be used as the polymerized toner as they are or with the addition of an external additive, but so-called "core-shell type" (or "capsule type") colored polymer particles having the colored polymer particles as a core layer and formed with a shell layer different from the core layer on the outside are preferable. The core-shell type colored polymer particles can be made of a core layer comprised of a low softening point substance covered by a substance having a higher softening point so as to obtain a balance between a reduction of the fixing temperature and prevention of aggregation at the time of storage.

The method for producing the core-shell type colored polymer particles using the above-mentioned colored polymer particles is not particularly limited. The particles may be produced by a conventional known method. The in situ polymerization method and phase separation method are preferable from the viewpoint of the production efficiency. The process of production of core-shell type colored polymer particles by the in situ polymerization method polymerizes the droplets of the polymerizable monomer composition in the above way and, when the polymerization substantially ends (preferably when the polymer conversion rate is 90%) and the colored polymer particles forming the core layer are formed, adds to the aqueous medium the polymerizable monomer for forming the shell layer (shell polymerizable monomer) and the polymerization initiator and polymerizes the same to obtain core-shell type colored polymer particles.

As the shell polymerizable monomer, one similar to the above-mentioned polymerizable monomers may be used. As the polymerization initiator used for polymerization of the shell polymerizable monomer, potassium persulfate, ammonium persulfate, and other persulfate metal salts; 2,2'-azobis(2-methyl-N-(2-hydroxyethyl)propionamide), 2,2'-azobis-(2-methyl-N-(1,1-bis(hydroxymethyl)-2-hydroxyethyl) propionamide), and other azo-based initiators; and other water soluble polymerization initiators may be mentioned.

(4) Stripping Step

The aqueous dispersion medium containing the colored polymer particles obtained in the polymerization step (3) is then stripped. At the time of stripping, a dispersion stabilizer is preferably further added. A dispersion stabilizer of type similar to the one used when forming the colored polymer particles is preferable. The stripping is treatment placing the aqueous dispersion medium containing colored polymer particles in an evaporator, reducing the pressure of the vapor phase, blowing inert gas from the bottom of the vessel into the aqueous dispersion medium, and thereby removing the residual monomer or residual VOC contained in the colored polymer particles or their aqueous dispersion medium.

The stripping of this embodiment is performed by stirring the dispersion liquid of the colored polymer particles in an evaporator and injecting a gas comprised of air or an inert gas into the dispersion liquid of the colored polymer particles under conditions of a flow rate of the injected gas of 0.05 to 4 L/(hr·kg) and a pressure of the vapor phase of the evaporator of 5 to 80 kPa.

During the stripping, additional aqueous dispersion medium is preferably additionally added to the aqueous dispersion medium of the colored polymer particles. The amount is normally 1 to 200 parts by weight, more preferably 5 to 100 parts by weight, with respect to 100 parts by weight of the aqueous dispersion medium of the colored polymer particles. If in this range, the effect of the present invention can be obtained and the steps of washing, filtering, etc. after the stripping can be performed with a good productivity.

At the time of stripping, bubbles form on the surface of the dispersion liquid of the colored polymer particles. If these bubbles become excessive and overflow from the evaporator, the problem will arise of the gas circulating line connected to the top of the evaporator becoming contaminated etc. To suppress bubbling, it is preferable to add at least one type of non-silicone deformer selected from the group comprised of an oil/fat deformer, mineral oil deformer, polyether deformer, polyalkyleneglycol type nonionic surfactant, emulsion containing a polyalkyleneglycol type nonionic surfactant, and emulsion containing a mineral oil and a polyalkyleneglycol type nonionic surfactant to the aqueous dispersion medium of the colored polymer particles. Among these non-silicone deformers, from the viewpoint of the defoam effect and the toner properties, a mineral oil deformer, polyalkyleneglycol type nonionic surfactant, and emulsion containing an oil/fat and polyalkyleneglycol type anionic surfactant is preferable.

A mineral oil deformer is a modified hydrocarbon oil having a mineral oil as a base. As a commercially available product, for example, product name "Defoamer DF714S" made by Japan PCM etc. may be mentioned. A polyalkyleneglycol type nonionic surfactant is a nonionic surfactant comprised of a polyethyleneglycol type nonionic surfactant or polyoxyethylene-polyoxypropylene block copolymer. As a commercially available product, for example, product name "SN Defoamer-180" (deformer comprised of polyoxyalkylene type nonionic surfactant) made by San Nopco Ltd. may be mentioned. An emulsion of an oil/fat and polyalkyleneglycol type nonionic surfactant is an oil/fat emulsified by a polyalkyleneglycol type nonionic surfactant. As a commercially available product, for example, product name "SN Defoamer-1407K" (defoamer comprised of emulsion of oil/fat, polyethyleneglycol type nonionic surfactant, etc.) made by San Nopco Ltd. etc. may be mentioned. As a polyether deformer, product name "Adekanol LG-51", "Adekanol LG-109", and other polyether type surfactants made by Asahi Denka and product name "IP Defoamer U-510" and other special polyether compounds etc. made by NOF Corporation may be mentioned.

The amount used of the non-silicone deformer or other deformer is preferably 0.01 to 1 part by weight, more preferably 0.05 to 0.5 part by weight, further preferably 0.07 to 0.3 part by weight, with respect to 100 parts by weight of the polymerizable monomer composition. If the amount used of the deformer is too small, a sufficient defoam effect is sometimes hard to obtain, while if too great, the obtained toner easily declines in environmental properties, in particular durability and other print properties in an H/H environment.

The stripping can be ended when the residual monomer and residual VOC in the colored polymer particles reach the desired amounts or less, but from the viewpoint of the odor during printing etc. of obtained polymerized toner and environmental safety, it is preferably ended so that the amounts of residual monomer and residual VOC in the colored polymer particles after the stripping become not more than 50 ppm. Here, the residual monomer removed is a polymerizable monomer and includes a shell polymerizable monomer. Further, the residual VOC removed includes the organic solvent, residual polymerization initiator, and other volatile organic compounds used in the step of preparation of the polymerizable monomer composition and polymerization step in the aqueous medium, the volatile organic compounds formed by decomposition reactions of the same, etc. The gas injected in the present invention is, as explained above, air or inert gas, but an inert gas is preferable. Among the inert gases, nitrogen is more preferable.

The flow rate of the gas injected in this embodiment, an amount expressed by the volume of the gas injected per hour per kg of the colored polymer particles (standard state, unit L=liter), is 0.05 to 4 L/(hr·kg) in range, more preferably 0.07 to 3.5 L/(hr·kg), further preferably 0.1 to 3 L/(hr·kg). If less than this range, the speed of removal of the residual monomer and residual VOC becomes insufficient. If conversely greater than this range, the bubbling becomes greater, continuous stripping becomes difficult, and the aggregation of the colored polymer particles increases. Further, if greater than this range, a large amount of nitrogen or other gas is used, so the energy consumption ends up increasing. The flow rate of the gas preferably gradually increases as the stripping progresses. The ratio of the average flow rate in the second half of the stripping with respect to the average flow rate in the first half of the stripping is preferably 1.05 to 10 in range, more preferably 1.2 to 6, particularly preferably 1.5 to 5.

The stripping in this embodiment is performed at a pressure of the vapor phase of the evaporator of a reduced pressure of 5 to 80 kPa. This is preferably 10 to 75 kPa, more preferably 15 to 70 kPa, further preferably 30 to 65 kPa. If this range, the stripping efficiency is good. Further, aggregation of the colored polymer particles and bubbling due to boiling of the aqueous medium and other volatile ingredients from the inside of the aqueous dispersion medium containing the colored polymer particles in the evaporator are suppressed and stable stripping becomes possible.

At the time of stripping, bubbling occurs on the surface of the dispersion liquid of the colored polymer particles. The stripping conditions are preferably controlled so that the bubble level does not exceed 95% of the height of the evaporator and the range of fluctuation of the bubble level remains within 10% throughout the stripping.

The bubble level in the embodiment is the height of the bubbles from the bottom as a percent of the height of the evaporator (100%), that is, is indicated as the bubble level (%). This bubble level is measured by a bubble level meter. As the bubble level meter used, a noncontact type bubble level meter is preferable and a microwave type level meter is more preferable. If the level of the dispersion liquid in the evaporator is 60% of its height, the bubble level will be over 60%. To prevent the gas circulating line, condenser, etc. from being contaminated by the bubbles, the bubble level is preferably controlled to a range not exceeding 95%, more preferably not more than 93%. From the viewpoint of the efficiency of removal of the residual monomer and residual VOC, the bubble level is preferably not too low. That is, the bubble level is preferably maintained at a certain high level. More preferably, the bubble level is maintained at least at 70% so that the range of fluctuation of the bubble level remains within 10%. The lower limit of this bubble level is more preferably 75%, particularly preferably 85%.

Next, the system used for the stripping in the embodiment will be explained. This system, as shown in FIG. 1, is provided outside it with a gas circulating line. This gas circulating line has a blower 5, VOC removal apparatus 10, condenser 7, and condensation tank 8. The evaporator 1 is a vessel having a strength able to withstand the pressure required for the stripping. It may be common with or different from the vessel (reactor) used in the polymerization step. The evaporator 1 is provided with stirring blades 2 for stirring the dispersion liquid of the colored polymer particles inside it. Further, the evaporator 1 may be provided with a jacket (not shown) at its outside for heating or cooling in the polymerization stage and for heating in the stripping.

The nitrogen gas or other gas is blown from a gas source (not shown) through a gas blowing pipe 4 to the inside of the evaporator 1. While stirring, the temperature inside the evaporator 1 is raised to a predetermined temperature, then the gas from the blower 5 is blown from the opening of the blowing pipe 3 into the evaporator 1. Part of the aqueous dispersion medium, the residual monomer, and the residual VOC of the dispersion liquid are led through the gas circulating line 6 into the condenser 7, then are led to the condensation tank 8. The water and other liquid ingredients condensed and liquefied in the condensation tank 8 are recovered there (recovery line not shown). The gas ingredient is led through the gas circulating line 9 to the VOC removal apparatus 10. The VOC removal apparatus 10 is for example an adsorption tower packed with activated charcoal or a bubbling apparatus filled with cold water. The residual monomer and residual VOC are removed there. After this, the nitrogen gas or other gas ingredient can be recirculated from the gas circulating line 11 through the blower 5 for reuse. Further, the amount of the gas used is extremely small. It may be incinerated for disposal, but recirculation and reuse is more preferable.

As the stirring conditions in the stripping, a speed of the stirring blades of 1 to 50 rpm is preferable and 2 to 40 rpm is more preferable. The stirring blades 2 are not particularly limited, but wide paddle blades, wide pitched blades, blue margin blades and their deformed blades, full zone blades, wall wetter blades, or other stirring blades are preferable. Further, as disclosed in Japanese Patent Application Laid-Open No. 2001-117272, part of the stirring blades may stick out from the liquid surface.

(5) Polymerized Toner

The aqueous dispersion of the colored polymer particles obtained by the polymerization is, after the end of the polymerization, filtered, stripped of the dispersion stabilizer, dewatered, and dried in accordance with ordinary methods repeated several times in accordance with need. The dispersion stabilizer is removed by adding sulfuric acid or another acid to dissolve the dispersion stabilizer.

In the present invention, the colored polymer particles forming the polymerized toner have a ratio Dv/Dp of the volume average particle diameter Dv and number average particle diameter Dp of preferably 1.0 to 1.3, more preferably 1.0 to 1.2. If Dv/Dp exceeds these ranges, thin spots occur or the transferability, print density, and resolution drop in some cases. The volume average particle diameter and number average particle diameter of the colored polymer particles may for example be measured using a particle diameter measuring device (made by Beckmann Coulter Co., product name: Multisizer) etc.

The polymerized toner can be used as it is for development of an electrophotographic image, but the polymerized toner is preferably adjusted in chargeability, flowability, shelf stability, etc. by using a Henschel mixer or other high speed mixer to mix the colored polymer particles, external additive, and in accordance with need other particles so as to deposit or embed the external additive at the surfaces of the colored polymer particles. As the external additive, silica, aluminum oxide, titanium oxide, and other inorganic particles or organic resin particles normally used for the purpose of improving the flowability and chargeability may be mentioned.

EXAMPLES

The process of production of the present invention will be explained in further detail next by examples, but the present invention is not limited to the following examples. Note that the parts and percentages are based on weight unless otherwise indicated. The methods of the test performed in the examples were as follows:

(Measurement of Amount of Residual Monomer and Amount of Residual VOC)

3 g of colored polymer particles before stripping was precisely weighed up to mg units. To the 3 g of the colored polymer particles, 27 g of N,N-dimethylformamide was added and the mixture stirred for 15 minutes, then 13 g of methanol was added and the mixture further stirred for 10 minutes. The thus obtained solution was allowed to stand to cause the insolubles to settle. The supernatant of this solution was obtained as the measurement sample. 2 μl was injected into a gas chromatograph to quantify the amount of monomer and amount of VOC.

The measurement conditions of the gas chromatograph were a column of TC-WAX (0.25 mm×30 m), a column temperature of 80° C., an injection temperature of 200° C., and an FID detection side temperature of 200° C. As the standard samples for quantification, various compositions of N,N-dimethylformamide/methanol solutions were used.

The colored polymer particles before stripping were in a moist state, so the amount of monomer and amount of VOC in the colored polymer particles were calculated as ratios with respect to the solids of the moist colored polymer particles (that is, the colored polymer particles). That is, the calculated solid ratios were multiplied with the weight of the moist colored polymer particles to calculate the solid contents and calculate the amount of monomer and amount of VOC per solids. The solids in the moist colored polymer particles were found by the following procedure.

(i) The aqueous dispersion liquid of the colored polymer particles before stripping was sampled.

(ii) The sampled aqueous dispersion liquid was filtered to obtain the moist colored polymer particles.

(iii) The moist colored polymer particles were weighed to within mg units.

(iv) The moist colored polymer particles were dried at 105° C. for 1 hour and the dried solids were precisely weighed.

(v) The ratio of solids in the moist colored polymer particles was calculated from the difference in weight before drying and after drying.

The colored polymer particles after stripping were similarly measured for the amount of monomer and amount of VOC.

(Particle Diameter)

The volume average particle diameter Dv of the colored polymer particles and particle diameter distribution as expressed by the ratio Dv/Dp of the volume average particle diameter Dv and number average particle diameter Dp were measured by a particle diameter measuring device (made by Beckmann Coulter Co., product name: Multisizer). The measurement conditions were an aperture diameter of 100 μm, medium of Isothone II, concentration of 10%, and number of measured particles of 100,000.

Evaluation of Image (L/L, N/N, and H/H Environment Durability Printing Test)

For the printing test, a commercially available nonmagnetic one-component developer type printer (18 sheet machine) was used. The printer was filled with the toner and allowed to stand for one day and night at a temperature of 23° C. and humidity of 50%, that is, a normal temperature and normal humidity (N/N environment), then was used for continuous printing by a 5% print density. The fogging was measured for every 500 sheets. The fogging was measured as follows. White solid printing was performed, the printer was stopped in the middle, and the toner at the nonimage parts on the photosensitive member after development was adhered to adhesive tape (made by Sumitomo 3M, product name "Scotch Mending Tape 810-3-18"). This adhesive tape was stuck to new print paper and a whiteness meter (made by Nippon Denshoku Industries Co., Ltd.) was used to measure the whiteness. Similarly, as a reference, unused adhesive tape was stuck to the print paper, the whiteness was similarly measured, and the difference of the whitenesses was used as the fogging value. The smaller the fogging value, the smaller the fogging and the better the image quality indicated. For the durability test, the number of continuous sheets of printing enabling an image quality of a fogging value of not more than 1.5% to be maintained during white solid printing was tested up to 10,000 sheets. Test results indicated as 10,000 sheets indicate this criteria was met even with printing up to 10,000 sheets.

A similar print durability test was also conducted at an environment of a temperature of 10° C. and a humidity of 20% (L/L environment) to obtain the number of sheets where L/L environment fogging occurred. Further, a similar print durability test was conducted at an environment of a temperature of 30° C. and a humidity of 80% (H/H environment) to obtain the number of sheets where H/H environment fogging occurred.

Example 1

(1) Preparation of Polymerizable Monomer Composition

A polymerizable monomer comprised of 80.5 parts of styrene and 19.5 parts of n-butyl acrylate (Tg of copolymer obtained by copolymerization of these monomer=55° C.), 0.3 part of a polymethacrylic acid ester macromonomer (made by Toagosei Chemical Industry, product name "AA6", Tg=94° C.), 0.5 part of divinylbenzene, 0.1 part of t-dodecylmercaptan, 6 parts of carbon black (made by Mitsubishi Chemicals, product name "#25"), 1 part of a charge control agent (made by Hodogaya Chemical Co., Ltd., product name "Spiron Black TRH"), and 2 parts of a parting agent comprised of Fischer-Tropsch wax (made by Sutherl Co., product name "Paraflint Spray 30", endothermic peak temperature=100° C.) were wet pulverized using a media type wet crusher to prepare a polymerizable monomer composition.

(2) Preparation of Aqueous Dispersion Medium

To 200 parts of ion exchanged water, 10.2 parts of magnesium chloride was dissolved. To this aqueous solution, an aqueous solution of 50 parts of ion exchanged water in which 6.2 parts of sodium hydroxide was dissolved was added while stirring to form a water insoluble metal hydroxide colloid, that is, a magnesium hydroxide colloid, and prepare an aqueous dispersion medium. The particle diameter distribution of the formed colloid was measured by a particle diameter distribution measuring device (made by Nikkiso, product name: Microtrack), whereupon the particle diameter was a D50 (50% cumulative value of number particle diameter distribution) of 0.35 μm and a D90 (90% cumulative value of number particle diameter distribution) of 0.84 μm. The measurement in this Microtrack particle diameter distribution measuring device was performed under conditions of a measurement range of 0.12 to 704 μm, a measurement time of 30 seconds, and a medium of ion exchanged water.

(3) Preparation of Aqueous Dispersion Liquid of Shell Polymerizable Monomer 1 part of methyl methacrylate (homopolymer Tg=105° C.) and 100 parts of water were finely dispersed by an ultrasonic emulsifier to obtain an aqueous dispersion liquid of a shell polymerizable monomer. The particle diameter of the droplets of the shell polymerizable monomer was measured by a Microtrack particle diameter distribution measuring device after adding the obtained droplets to a 1% sodium hexametaphosphate aqueous solution by a concentration of 3%, whereupon the D90 was 1.6 μm.

(4) Formation of Droplets

The polymerizable monomer composition prepared at step (1) was charged into the aqueous dispersion medium containing a magnesium hydroxide colloid obtained in step (2) and stirred. Next, 6 parts of t-butylperoxy-2-ethylhexanoate (made by NOF Corporation, product name "Perbutyl O") was added as a polymerization initiator to the aqueous dispersion medium, then the mixture was stirred with a high shear force using an in-line type emulsion disperser (made by Ebara Corporation, product name "Ebara Milder") so as to form droplets of the polymerizable monomer composition in the aqueous dispersion medium. In this way, an aqueous dispersion liquid in which the polymerizable monomer composition was dispersed was prepared.

(5) Polymerization Step

The aqueous dispersion liquid in which the droplets of the polymerizable monomer composition prepared at step (4) were dispersed was placed in a reactor equipped with stirring blades and raised in temperature to 85° C. for a polymerization reaction. The polymerization reaction was performed until the polymerization conversion rate reached about 100%. At that time, an aqueous dispersion liquid of the aqueous dispersion liquid of the shell polymerizable monomer prepared at step (3) into which 0.1 part of 2,2'-azobis[2-methyl-N-(2-hydroxyethyl)-propionamide] (made by Wako Pure Chemical Industries, Ltd., product name "VA-086") was dissolved as a water soluble initiator was added to the reactor. The polymerization was continued for 4 hours, then the system was cooled to stop the reaction and obtain a dispersion liquid containing the formed core-shell type colored polymer particles (hereinafter referred to as "colored polymer particle dispersion liquid"). The solid concentration of this colored polymer particle dispersion liquid was 27%. At this point of time, the amount of the residual monomer and the amount of the VOC in the colored polymer particles before stripping were measured.

(6) Stripping Process

The system shown in FIG. 1 was used for stripping the colored polymer particle dispersion liquid obtained at step (5). A microwave type level meter (made by Tokimec Inc., registered trademark "Levelpro RTG-40") was set at the top of the evaporator 1. This was used as a noncontact type bubble level meter 12. The colored polymer particle dispersion liquid was diluted by ion exchanged water to a solid concentration of 20%, then was supplied to the evaporator 1. Next, 0.1 part of a deformer (made by San Nopco Ltd., product name "SN Defoamer 180"; emulsion of oil/fat, oxyalkylene type nonionic surfactant, etc.) and 10 parts of an aqueous dispersion medium similar to the aqueous dispersion medium prepared at step (2) were added to the evaporator 1. Nitrogen gas was run into the evaporator 1 to replace the vapor phase with nitrogen gas. Next, the colored polymer particle dispersion liquid was stirred by the stirring blades 2 at a stirring speed of 20 rpm while heating to 75° C., then the blower 5 was started up to adjust the flow rate of the nitrogen gas to 1.0 L/(hr·kg), blow nitrogen gas into the colored polymer particle dispersion liquid from a gas blowing pipe 4 having a straight pipe shaped gas blowing port and thereby start the stripping.

The nitrogen gas blown in was successively led through the gas circulating line 6 to the condenser 7 and condensation tank 8. The condensed nitrogen gas was led through the gas circulating line 9 to the VOC removal apparatus (adsorption tower packed with activated charcoal) 10 where the monomer and VOC and other volatile matter contained in the nitrogen gas were removed.

The stripping was performed at a temperature of the colored polymer particle dispersion liquid of 75° C., a pressure in the evaporator 1 of 40 kPa, and a flow rate of the nitrogen gas in the first half of the stripping (average of flow rate in the first half of the time during which stripping was performed) of 1.0 L/(hr·kg). The bubble level at the start of the stripping was 92.5%. As the treatment time elapsed, the bubble level descended and the nitrogen gas flow rate was increased step by step. The flow rate of the nitrogen gas in the second half of the stripping was 3.0 L/(hr·kg). Along with the increase in the flow rate of the nitrogen gas, the bubble level becomes a bubble level remaining in the vapor phase in the evaporator (not more than 95%), preferably a bubble level of a range not obstructing operation at all and enabling the removal ability to be maintained high (90% or more).

The stripping was performed for 5.5 hours while controlling the flow rate of the nitrogen gas in this way. After this, the obtained aqueous dispersion liquid was cooled to 25° C. The obtained stripped colored polymer particles were sampled and measured for the amount of residual monomer and the amount of VOC at the end of the stripping.

(7) After Stripping Process

After step (6), while stirring the dispersion liquid of the colored polymer particles, sulfuric acid was added for acid washing (25° C., 10 minutes), then the pH of the dispersion liquid was adjusted to 4.5 or less. This dispersion liquid was dewatered, washed, and filtered for separation of the solids by a continuous belt filter (made by Sumitomo Heavy Industries Ltd., product name "Eagle Filter"). The solids were dried by a drier at 45° C. for 10 hours to obtain colored polymer particles (core-shell type colored polymer particles) having a volume average particle diameter Dv of 7.5 μm and a particle diameter distribution Dv/Dp of 1.19.

To 100 parts of the dried colored polymer particles, 0.8 part of a hydrophobically treated silica having an average particle diameter of 14 nm (made by Nippon Aerosil Co., Ltd., product name "RX200") was added. This was mixed using a Henschel mixer to prepare a polymerized toner. The obtained polymerized toner was used for an image test. The results are shown in Table 1.

Examples 2 to 4

In each case, the same procedure was performed as in Example 1 to prepare a polymerized toner except in that in the stripping step of Example 1, the flow rate of nitrogen gas injected in the first half and second half of the treatment, the amount of addition of the nitrogen deformer, the pressure of the vapor phase inside the evaporator, and the temperature of the colored polymer particle dispersion liquid were changed as shown in Table 1. The times required for the stripping were 8.5 hours, 7 hours, and 6 hours. The results of the print test are shown in Table 1.

Example 5

In Example 5, the amount of residual ether and the amount of residual styrene in the polymerized toner were measured as follows. 3 g of the polymerized toner was weighed out to a 1 mg unit. To the 3 g of the polymerized toner, 27 g of ethyl acrylate was added. The mixture was stirred for 15 minutes, then 13 g of methanol was added and the mixture stirred for another 10 minutes. The thus obtained solution was allowed to stand to cause the insolubles to settle. The supernatant of this solution was taken as a measurement sample. 2 μl was injected into a gas chromatograph and the styrene and ether ingredients were quantitatively analyzed. The measurement conditions of the gas chromatograph were as follows. The column was a product name DB-5 made by Agilent and having a size of 0.25 mm×30 m. The column was held at a temperature of 40° C. for 3 minutes, then raised to 130° C. by 10° C./min. After reaching 130° C., it was raised by 20° C./min to 230° C. The injection temperature was 200° C., while the FID detection side temperature was 250° C. The standard sample for quantitative analysis was made an ethyl acrylate/methanol solution of the ingredient to be detected the same as the above.

In Example 5, the print durability test (number of occurrences of N/N environment fogging, number of occurrences of H/H environment fogging) was conducted as follows. The polymerized toner was charged into a commercially available nonmagnetic one-component development type printer (printing speed 18 sheets (A4 size)/min), allowed to stand in an environment of a temperature of 23° C. and a humidity of 50% (N/N environment) for one day and night, then used for continuous printing under the same N/N environment by a 1% print density. For every 1,000 sheets, the printing was stopped once to measure the fogging. The number of sheets where the fogging ΔE became 1 or more was defined as the number of occurrences of N/N environment fogging. The fogging was determined by, first, performing white field printing (printing of an image originally not to be printed in any way), stopping the printer in the middle of the printing, peeling off the toner of the non-image parts on the photosensitive body after development by adhesive tape (made by Sumitomo 3M, product name: Scotch Mending Tape 810-3-18), and sticking this on a new print paper. The locations of the non-image parts where toner is adhered were measured for hue by a spectral color difference meter (made by Nippon Denshoku Industries Co., Ltd.), product name SE-2000). Similarly, as a control, unused adhesive tape was stuck to the print paper, this was used as a reference sample, the hue was similarly measured. The hues were expressed as coordinates in an L*a*b* space, then the color difference ΔE was calculated from the hues of the measurement sample and reference sample and used as the fogging value. The smaller the fogging value, the smaller the fogging and the better the image quality indicated.

A similar print durability test was also conducted at an environment of a temperature of 28° C. and a humidity of 80% (H/H environment) to obtain the number of sheets where H/H environment fogging occurred.

A core use polymerizable monomer comprised of styrene in an amount of 75 parts and n-butyl acrylate in 25 parts, a macromonomer comprised of a polymethacrylic acid ester (made by To a Gosei, product name AA6) in an amount of 0.25 part, a copper phthalocyanine pigment (made by Dainippon Ink and Chemical, product name CTBX121) in an amount of 1 part, and a charge control agent (styrene/acrylic resin, made by Fujikura Chemical, product name FCA-207P) in an amount of 1 part were stirred and mixed by an ordinary stirring device having a rotor, then uniformly dispersed by a media type disperser. Here, as the parting agent, pentaerythritol tetramyristate was added in 5 parts, then the mixture was mixed and made to dissolve to obtain a core use polymerizable monomer composition.

Separate from this, at 25° C., an aqueous solution comprised of ion exchanged water in an amount of 250 parts into which magnesium chloride (aqueous multivalent metal salt) in an amount of 8.6 parts was dissolved was stirred and an aqueous solution comprised of ion exchanged water in an amount of 50 parts in which sodium hydroxide (alkali metal hydroxide) in an amount of 4.8 parts was gradually added to prepare a dispersion of a magnesium hydroxide colloid (water insoluble metal hydroxide colloid). The particle diameter distribution of the obtained colloid was measured by a particle diameter distribution measuring device (made by Shimadzu Seisakusho, product name SALD tangible distribution measuring device), whereupon D50 (50% cumulative value from small particle diameter of number particle diameter distribution) was found to be 0.36 μm and D90 (same 90% cumulative value) was 0.80 μm.

To the dispersion of the magnesium hydroxide colloid, the core use polymerizable monomer composition was added at 25° C. An ordinary stirring device provided with a rotor was used to stir the crude droplets produced until becoming stable. Here, a polymerization initiator comprised of t-butylperoxy diethylacetate in an amount of 4.5 parts, a molecular weight modifier comprised of tetraethylthiuram disulfide (TETD) in 1.0 part, and a cross-linkable polymerizable monomer comprised of divinyl benzene in 0.5 part were added. A high speed shear rate stirring machine (made by Ebara Corporation, product name Ebara Milder) was used to stir this with a high speed shear rate at 15,000 rpm in speed for 10 minutes to form droplets of the polymerizable monomer composition.

Separate from this, at 25° C., an aqueous solution comprised of ion exchanged water in an amount of 39.64 parts into which magnesium chloride in an amount of 1.51 parts was dissolved was stirred and an aqueous solution comprised of ion exchanged water in an amount of 7.93 parts in which sodium hydroxide in an amount of 0.92 part was gradually added to prepare a precharge amount of a dispersion of a magnesium hydroxide colloid.

Separate from this, a solution comprised of a shell use polymerizable monomer comprised of methyl methacrylate in an amount of 1 part and a shell use water soluble polymerization initiator comprised of product name VA086 made by Wako Pure Chemical Industries, Ltd. in 0.1 part dissolved in ion exchanged water in an amount of 10 parts was prepared.

A reactor provided with a stirring device having a rotor was prepared. From above this reactor, the precharge amount of dispersion of a magnesium hydroxide colloid was sprayed through a sprayer onto the walls of the reactor and the stirring machine. The sprayed precharge amount of the dispersion of the magnesium hydroxide colloid collected at the bottom of the reactor.

The reactor was charged from above with the aqueous dispersion in which the droplets of the core use polymerizable monomer were dispersed. At this time, the precharge amount of the dispersion of the magnesium hydroxide colloid collected at the bottom of the reactor softened the dropping impact of the aqueous dispersion with the droplets of core use polymerizable monomer dispersed in it.

The solution in the reactor was warmed by the jacket provided at the outside of the reactor. By warming the solution to 90° C., the polymerization reaction of the core use polymerizable monomer composition was started. The polymerization reaction was continued. When the polymerization conversion rate reached 95%, the temperature inside the system was held at 90° C. and the shell use polymerizable monomer and the shell use water soluble polymerization initiator were added. Further, the temperature inside the system was held for 3 hours at 90° C. to continue the polymerization reaction, then cooling water was circulated through the jacket to lower the temperature inside the system to ordinary temperature (about 25° C.) and thereby stop the polymerization reaction. Due to the above operation, in the reactor, an aqueous dispersion containing the core-shell type colored polymer particles was obtained. The solution inside the reactor had a pH of 0.5.

The obtained aqueous dispersion containing the colored polymer particles was stripped in the following way using the apparatus shown in FIG. 1. First, the obtained aqueous dispersion containing the colored polymer particles was diluted by adding ion exchanged water to a solids concentration of 20%. The diluted aqueous dispersion containing the colored polymer particles was supplied to an evaporator 1. There, a non-silicone based defoamer (made by San Nopco, product name SN Defoamer 180) was added in an amount of 1 part. Inside the evaporator 1, nitrogen gas was run to replace the gas layer with nitrogen gas. Next, the aqueous dispersion containing the colored polymer particles was stirred by a rotor 2 at 20 rpm and warm water was run through a jacket provided in contact with the outside of the evaporator 1 so as to warm the evaporator and heat the inside aqueous dispersion containing the colored polymer particles to 80° C. After this, nitrogen gas was blown into the aqueous dispersion containing the colored polymer particles from a gas blowing pipe 4 with a gas blowing port of a straight pipe shape so as to remove the volatile substances in the solution. This stripping step was performed in the evaporator for 6 hours while adjusting the liquid temperature to 80° C., the pressure to 48 kPa, and the flow rate of the nitrogen gas to 0.1 L/hr·kg. During this time, the bubble level was held at 90% to 95%. After this, the aqueous medium containing the colored polymer particles was cooled to 25° C. by running cooling water through the above-mentioned jacket.

The cooled aqueous medium containing the colored polymer particles was stirred and sulfuric acid added to this to neutralize the solution to a pH of 4.5 for acid washing. The neutralized aqueous dispersion containing the colored polymer particles was filtered to separate (filter out) the wet state colored polymer particles. After this, new ion exchanged water in an amount of 500 parts was added to convert the wet state colored polymer particles to a slurry again then this was again filtered. This conversion to slurry and filtration were repeated a total of five times to wash the wet state colored polymer particles. The washed wet state colored polymer particles were dried by a vacuum dryer at a temperature of 50° C. and pressure of 4 kPa for 24 hours to obtain dried colored polymer particles (in the present embodiment, sometimes simply referred to as "colored polymer particles").

The obtained colored polymer particles were core-shell type colored polymer particles having a volume average particle diameter (Dv) of 9.5 μm, a particle diameter distribution (Dv/Dp) of 1.16, a shell thickness of 0.03 μm, and a sphericity Sc/Sr of 1.2.

To 100 parts of the colored polymer particles, hydrophobically treated particles (made by Cabot, product name TG820F) in an amount of 0.8 part and hydrophobically treated particles (made by Nippon Aerosil, product name NA50Y) in an amount of 1 part were added and a Henschel mixer was used to mix them. These were externally added to obtain a nonmagnetic one-component polymerized toner. The test results of the obtained toner are shown in Table 1.

Comparative Examples 1 and 2

In each case, the same procedure was performed as in Example 1 to prepare a polymerized toner except that the stripping in Example 1 was performed without injection of nitrogen and the amount of addition of the nitrogen deformer, the pressure of the vapor phase inside the evaporator, the bubble level, and the temperature of the colored polymer particle dispersion liquid were set as shown in Table 1. The times required for the stripping were 24 hours and 18 hours. The results of the print test are shown in Table 1.

Comparative Examples 3 and 4

In each case, stripping was performed while changing the flow rates of nitrogen gas injected in the first half and second half of the treatment, the amount of addition of nitrogen deformer, the pressure of the vapor phase inside the evaporator, and the temperature of the colored polymer particle dispersion liquid of Example 1 as shown in Table 1. In both Comparative Example 3 and Comparative Example 4, during the stripping, bubbling vigorously occurred, the bubbles overflowed from the evaporator and entered the condenser to contaminate it, so the subsequent treatment became impossible. The subsequent steps were therefore suspended.

Comparative Example 5

Figure 2:
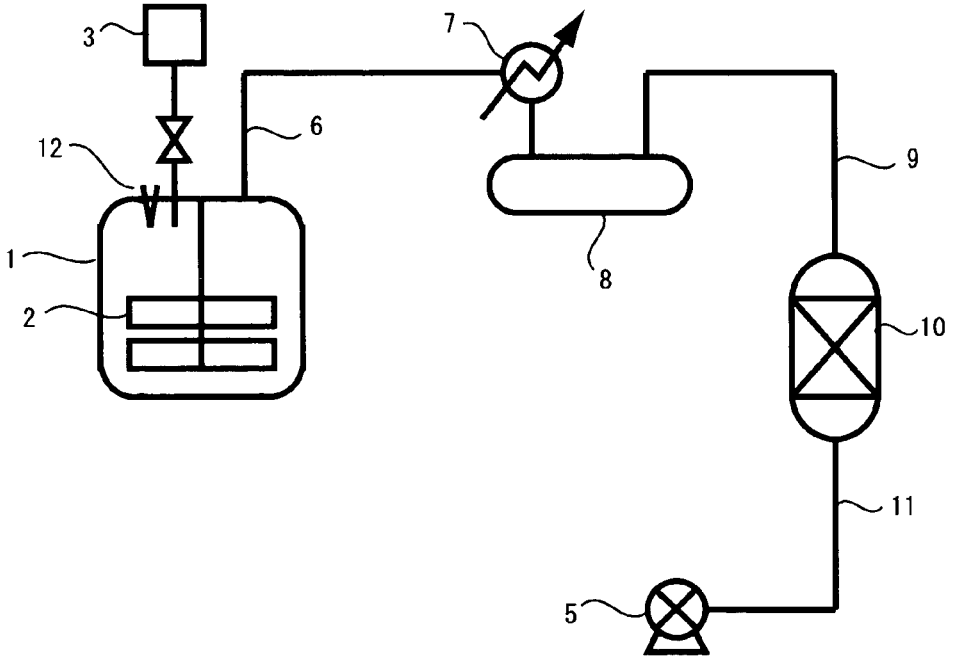

The stripping in Example 1 was performed using the system shown in FIG. 2 comprised of the system of FIG. 1 used in Example 1 partially remodeled. In this system, the injected nitrogen was blown into the vapor phase. The flow rate of nitrogen gas injected in the first half and second half of the treatment, the amount of addition of the nitrogen deformer, the pressure of the vapor phase inside the evaporator, and the temperature of the colored polymer particle dispersion liquid were set as shown in Table 1 for the stripping by this system. The flow rate of the nitrogen was the flow rate corresponding to the example described in the above-mentioned Japanese Patent Application Laid-Open No. 2001-92180. The results of the print test are shown in Table 1.

TABLE 1

| | | Examples | | | | | Comparative Examples | | | | |
|---|---|---|---|---|---|---|---|---|---|---|---|
| | | 1 | 2 | 3 | 4 | 5 | 1 | 2 | 3 | 4 | 5 |
| | | | | | (Stripping step) | | | | | | |
| Amount of addition of deformer(parts) | | 0.1 | 0.175 | 0.2 | 0.125 | 0.1 | 0.05 | 0.1 | 0.2 | 0.2 | 0.1 |
| Pressure (kPa) | | 40 | 20 | 20 | 60 | 48 | 20 | 60 | 40 | 101 | 40 |
| Injection position | | Liquid | Liquid | Liquid | Liquid | Liquid | Liquid | Liquid | Liquid | Liquid | Vapor |
| Flow rate | 1st half | 1 | 0.2 | 2 | 0.2 | 0.1 | 0 | 0 | 4.2 | 12 | 4.2 |
| (L/hr · kg) | 2nd half | 3 | 0.4 | 4 | 0.4 | 0.1 | 0 | 0 | 4.2 | 12 | 4.2 |
| Bubble level (%) | | 92.5 | 92.5 | 92.5 | 92.5 | 90–95 | 80 | 80 | ≧95 | ≧95 | 80 |
| Temperature (° C.) | | 75 | 60 | 60 | 85 | 90 | 60 | 85 | 75 | 90 | 75 |
| Treatment time (h) | | 5.5 | 8.5 | 7 | 6 | 6 | 24 | 18 | — | — | 15 |
| Treatment stability | | Good | Good | Good | Good | Good | Good | Good | Poor (stop) | Poor (stop) | Good |
| | | | | | (Residual monomer) | | | | | | |
| Before treatment (ppm) | | 185 | 185 | 185 | 185 | — | 185 | 185 | 185 | 185 | 185 |
| After treatment (ppm) | | ≦50 | ≦50 | ≦50 | ≦50 | — | ≦50 | ≦50 | — | — | ≦50 |
| | | | | | (Residual VOC) | | | | | | |
| Before treatment (ppm) | | 6128 | 6128 | 6128 | 6128 | — | 6128 | 6128 | 6128 | 6128 | 6128 |
| After treatment (ppm) | | ≦50 | ≦50 | ≦50 | ≦50 | — | ≦50 | ≦50 | — | — | ≦50 |
| Residual ether (ppm) | | — | — | — | — | 22 | — | — | — | — | — |
| Residual styrene(ppm) | | — | — | — | — | 15 | — | — | — | — | — |
| | | | | | (Test results) | | | | | | |
| Environ. durable printing (sheets) | H/H | 10,000 | 10,000 | 9,000 | 8,500 | 14,000 | 7,000 | 8,000 | — | — | 7,000 |
| | N/N | 10,000 | 9,000 | 10,000 | 10,000 | 15,000 | 6,500 | 7,000 | — | — | 6,500 |
| | L/L | 8,000 | 7,500 | 10,000 | 9,000 | — | 6,000 | 6,500 | — | — | 6,000 |

The following will be understood from the test results described in Table 1. In Comparative Examples 1 and 2, where the stripping steps comprised only reduction of pressure and not injection of nitrogen, the treatment required a long time and the obtained polymerized toner dropped in print durability. In Comparative Examples 3 and 4, where the flow rate of injection of nitrogen was greater than the prescribed range, the bubbling was vigorous during the stripping and the subsequent steps were stopped. In Comparative Example 5, where the stripping step comprised injection of nitrogen into the vapor phase, like in Comparative Examples 1 and 2, the treatment required a long time and the obtained polymerized toner dropped in print durability. As opposed to this, in Examples 1 to 4, the stripping step could be performed stably and a polymerized toner having excellent print durability at all of a low temperature and low humidity, normal temperature and normal humidity, and high temperature and high humidity was produced.

Note that the above embodiments and examples were described for the purpose of facilitating understanding of the present invention and not for limiting the present invention. Therefore, the elements disclosed in the above embodiments and examples include all design changes and equivalents falling in the technical scope of the present invention.

The present disclosure relates to content contained in Japanese Patent Application No. 2005-252819 filed on Aug. 31, 2005, and Japanese Patent Application No. 2006-50836 filed on Feb. 27, 2006, the entire disclosure of which is incorporated here by reference.

INDUSTRIAL APPLICABILITY

The polymerized toner obtained by the method of production of the present invention can be used as a developer in a facsimile, copier, printer, or other image forming apparatuses using the electrophotographic process.

The invention claimed is:

1. A method for producing a polymerized toner comprising:

a step of polymerizing a polymerizable monomer composition containing a colorant and polymerizable monomer in an aqueous dispersion medium in the presence of a polymerization initiator to obtain a dispersion liquid of colored polymer particles; and a stripping step of injecting a gas comprised of air or an inert gas into the dispersion liquid of the colored polymer particles while stirring the dispersion liquid in an evaporator;

the flow rate of the gas injected per weight of the colored polymer particles being 0.05 to 4 L/(hr·kg), and the pressure of the vapor phase of the evaporator being 5 to 80 kPa.

2. A method for producing a polymerized toner as set forth in claim 1, wherein, in the stripping step, said aqueous dispersion medium contains at least one type of non-silicone deformer selected from the group comprised of an oil/fat deformer, mineral oil deformer, polyether deformer, polyalkyleneglycol type nonionic surfactant, emulsion containing an oil/fat and polyalkyleneglycol type nonionic surfactant, and emulsion containing a mineral oil and polyalkyleneglycol type nonionic surfactant.

3. A method for producing a polymerized toner as set forth in claim 1, wherein the stripping conditions are controlled so that the bubble level on the surface of the dispersion liquid of the colored polymer particles is not more than 95% of the height of the evaporator and the range of fluctuation of the bubble level becomes within 10% throughout the stripping process.

4. A method for producing a polymerized toner as set forth in claim 1, wherein the stripping step stirs the dispersion liquid of the colored polymer particles at a stirring rate of 1 to 50 rpm in range.

5. A method for producing a polymerized toner as set forth in claim 1, wherein the stripping step controls the dispersion liquid of the colored polymer particles to a temperature of 45° C. to 90° C.

6. A method for producing a polymerized toner as set forth in claim 1, wherein the polymerizable monomer composition contains a molecular weight modifier in an amount of 0.01 part by weight to 2 parts by weight with respect to 100 parts by weight of the monovinyl monomer forming the main ingredient of the polymerizable monomer.

7. A method for producing a polymerized toner as set forth in claim 1, wherein the flow rate of the gas in the stripping step is gradually increased as the stripping progresses.

8. A method for producing a polymerized toner as set forth in claim 7, wherein in the stripping step, a ratio of the average flow rate in the second half of the stripping with respect to the average flow rate in the first half of the stripping is 1.05 to 10 in range.

9. A method for producing a polymerized toner as set forth in claim 1, further including a step of depositing or embedding an external additive in the colored polymer particles obtained by the above steps.

10. A method for producing a polymerized toner as set forth in claim 9, wherein the external additive is comprised of inorganic particles or organic resin particles.

11. A method for producing a polymerized toner as set forth in claim 10, the inorganic particles comprising the external additive are comprised of silica, aluminum oxide, or titanium oxide.

12. A method for producing a polymerized toner as set forth in claim 1, the average flow rate in the first half of the stripping step being lower than the average flow rate in the second half of the stripping step.

* * * * *